United States Patent [19]

Helm

[11] 3,998,116

[45] Dec. 21, 1976

[54] APPARATUS FOR REMOVING CUT PANELS FROM SHEET MATERIAL

[75] Inventor: Herbert W. Helm, Hollidaysburg, Pa.

[73] Assignee: F. L. Smithe Machine Company, Inc., Duncansville, Pa.

[22] Filed: Mar. 3, 1975

[21] Appl. No.: 554,534

[52] U.S. Cl. ..... 83/98; 83/100

[51] Int. Cl.[2] ..... B26D 7/06

[58] Field of Search ..... 83/98, 99, 100

[56] References Cited

UNITED STATES PATENTS

| | | | |
|---|---|---|---|
| 2,279,768 | 4/1942 | Ulrich | 83/98 |
| 2,302,855 | 11/1942 | Hallman | 83/100 |
| 3,680,419 | 8/1972 | Stoop | 83/98 |

*Primary Examiner*—Donald R. Schran
*Attorney, Agent, or Firm*—Stanley J. Price, Jr.; John M. Adams

[57] ABSTRACT

Window panels are cut in sheet material by means of a rotatable panel cutter and the sheet material is thereafter conveyed to a location adjacent a panel or chip receiving means. A negative pressure is applied to the underside of the sheet, the cut panel or chip is conveyed away from the sheet by the negative pressure. Turnaround rollers are provided for the sheet material. Where the panel is not completely severed from the sheet, a portion of the panel will be deflected by the turnaround roller and a blade is positioned adjacent the turnaround roller to engage the panel and remove the panel from the sheet. Air blast means are provided in overlying relation with the web above the panel receiving means to dislodge the panel from the sheet so that the air blast means will also dislodge the severed panel in the sheet passing between the panel receiving means and the air blast means.

8 Claims, 2 Drawing Figures

APPARATUS FOR REMOVING CUT PANELS FROM SHEET MATERIAL

BACKGROUND OF THE INVENTION

1. Field of the Invention

This invention relates to apparatus for removing cut panels from sheet material and more particularly, to apparatus for removing cut panels in an endless web in the production of window envelopes.

2. Description of the Prior Art

In envelope making machines, the window openings are cut in a continuous web or in individual envelope blanks that are conveyed between a rotary type window or panel cutter and a backing anvil. Frequently, the cutting operation is such that the panel or chip is not completely separated at the cut edges and this is especially true when the cutting die is slightly worn. Thus, frequently the panel or chip is incompletely separated and the uncut panel or chip must be physically removed from the window openings.

In the past, several arrangements were provided to remove the panel or chip from the web or envelope blank. In one arrangement, as is illustrated in U.S. Pat. No. 3,186,274, the panels were removed by means of pins mounted on a roller that would pierce the panel and remove the panel from the web or envelope blank. Problems were encountered with the pin arrangement in that the pins were frequently broken when the envelope machine was operated at high speed to render the panel removal apparatus inoperative.

Also, other arrangements, such as gripper fingers have been used. The same disadvantages, however, are present with the gripper fingers. Both suction and air under pressure have been utilized with the rotating roller to secure the panel or chip to the roller and to positively discharge the panel from the roller. This type of panel removal apparatus increases the cost of the dies and the valve assemblies to provide the suction and air under pressure. Further, the valves generate heat and require changing when the roller is changed during an envelope size change. Other panel removing devices are disclosed in U.S. Pat. Nos. 1,007,856; 1,290,301; 1,614,488 and 3,103,842.

There is a need for simple, inexpensive apparatus to positively remove the panels or chips from the web or envelope blank that is operable at high speeds.

SUMMARY OF THE INVENTION

This invention relates to panel removal apparatus associated with the rotatable panel cutter having a backing anvil. The apparatus includes a panel receiving means positioned downstream of the panel cutter and adjacent to the underside of the web as it is conveyed from the panel cutter apparatus. The panel or chip receiving means has a suitable source of negative pressure adjacent to the underside of the web. The negative pressure may be created by a vacuum pump or by air flowing through a venturi adjacent the chip receiving means. A hood may also be utilized as the chip receiving means. The negative pressure removes the panels from the web and discharges the panels through a suitable exhaust device. Where air is blown through a venturi in the chip receiving means, the chips may be conveyed directly to a storage receiver. The web is reeved about a turnaround roll in such a manner that the web is wrapped around a portion of the turnaround roll. An interference blade is positioned adjacent to the turnaround roll and is arranged to engage a portion of the clipping remaining in the window and dislodge the clipping remaining in the window and dislodge the clipping from the web. A portion of the chip receiving means is positioned adjacent the turnaround roll and is arranged to remove the clipping disengaged from the web at a location adjacent the turnaround roll.

An air blast device is positioned above the web and chip receiving means. The web is arranged to pass between the chip receiving means and the air blast device. The air blast device may be utilized to provide positive air pressure on the upper surface of the web to disengage the chip or panel from the web so that the negative pressure in the chip receiving means will convey the chip to the receiver. With this arrangement, the negative pressure removes the chips from the web while the web is travelling at high speeds for high envelope production. The other chip removal devices, such as the interference blade and the air blast device may be utilized where difficulty is encountered in removing the chip by negative pressure alone.

Accordingly, the principal object of this invention is to provide a chip removal apparatus which positively removes chips or panels from the windows formed in a web or envelope blank.

Another object of this invention is to provide a chip removal device that permits the envelope machine to operate at high speeds.

DESCRIPTION OF THE PREFERRED EMBODIMENT

For simplicity and clarity of illustration, the work performing elements of the window cutting apparatus are illustrated schematically and not illustrated in detail. It should be understood that the various rollers are rotatably secured in the side frames of the envelope making machine and are driven in timed relation to periodically form windows in the web which will later be severed into envelope blanks.

Figure 1:
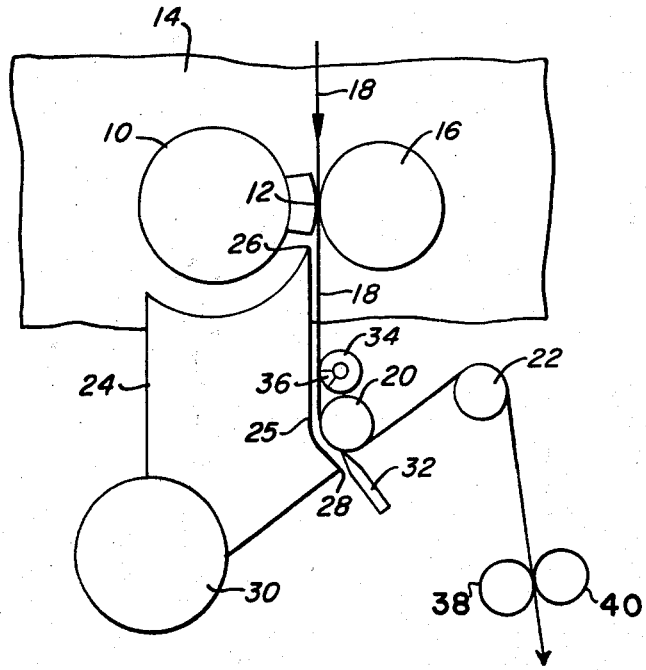
FIG. 1 is a diagrammatic view in elevation, of the window cutting apparatus having the improved panel removing device employing the features of the present invention.

Referring to FIG. 1, the apparatus includes a rotatable panel cutter roller or shaft 10 that has a cutter die or knife 12 secured to the periphery thereof. Although the knife illustrated has a generally rectangular configuration, the knife may have any suitable configuration. The panel cutter roller is rotatably mounted in the envelope machine frame 14 and is suitably driven in timed relation with other elements of the envelope making machine. A backing roll or anvil 16 is mounted adjacent to the panel cutter roll 10 and is arranged to provide a hard backing surface of the panel cutter die or knife 12. An endless web of paper 18 is conveyed between the panel cutter roll 10 and backing anvil 16 at a preselected speed so that the knife 12 cuts panels or windows in the web at preselected locations on the web. Although anvil 16 is illustrated as an anvil roller, it should be understood that a stationary cylinder or knife blade type anvil may also be employed.

The web 18, with the windows formed therein, is conveyed downwardly from the panel cutter assembly by suitable pull rolls 38 and 40 and is reeved about a pair of turnaround rolls 20 and 22. A panel receiving means, which in FIG. 1 has the configuration of a hood 24 is positioned adjacent the underside of the web and has a top edge portion 26 adjacent the cutter die 12 and a bottom edge portion 28 that surrounds a portion of turnaround roll 20. The hood 24 has a side portion 25 that is open and is closely adjacent to the underside of the web 18 between the panel cutter roller 10 and the turnaround roll 20. The hood 24 is connected to a suitable source of negative pressure which is diagramatically illustrated and designated by the numeral 30. The source of negative pressure may be a conventional suction fan connected by suitable piping to the hood 24 or may be an air flow conduit with a venturi section, as illutrated in FIG. 2, and later described. With either arrangement, a negative pressure is applied to the underside of the web 18 through the hood 24 and removes the chips or panels cut in the web. Where the cutter die 12 substantially completely severs the panel from the web, the negative pressure applied to the underside of the web will remove the chip or panel from the web and convey the chip to a suitable chip receiver. The web is maintained under sufficient tension between the panel cutter roll 10 and turnaround roll 20 to maintain the web 18 in spaced relation to the hood side portion 25 so that the web is not frictionally engaged to the hood by the negative pressure.

The web is thereafter conveyed around the turnaround roll where the web is wrapped around a substantial portion of the roll. The lower edge of the hood 28 is adjacent to the turnaround roll 20 so that a negative pressure is applied to the web as it is conveyed around turnaround roll 20. Where the panel or chip is not completely cut by the die so that the negative pressure in the hood 24 removes the clipping as the web is conveyed from the panel cutter roll 10 to the turnaround roll 20, the change in direction of the web by means of the turnaround roll 20 will disengage the panel from the web and the panel will be removed by the negative pressure in hood 24.

Where desired, an auxiliary clipping removing device may be utilized that includes a knife blade 32 positioned adjacent to either the turnaround roll 20 or anvil 16. Any chips or panels that are not removed by the negative pressure in hood 24 will be removed by the knife blade 32. As the web is conveyed about the turnaround roll 20 or anvil 16, at least a portion of the panel or clipping will be deflected outwardly beyond the periphery of the turnaround roll 20 or anvil 16 and will be engaged by the knife blade 32 to mechanically remove the panel or chip from the web 18.

Where desired, another device may be employed to remove the panels or clippings from the web 18, either separately or in conjunction with the negative pressure. This device includes any suitable air blast means 34 positioned in overlying relation with and adjacent the top side of the web 18. Air under pressure may be applied through outlet 36 onto the upper surface of the web to dislodge the clipping from the web so that conveyed to a suitable chip receiving means, such as hood 24.

In FIG. 1, the hood 24 is illustrated as being connected to a suitable suction device 30 that may include a suction fan to provide the negative pressure for the underside of the web 18. The suction device 30 may be positioned adjacent to the underside of the web 18 without an elaborate hood or enclosure. All that is required is a sufficient negative pressure on the underside of the web 18 to remove the panels therefrom.

Figure 2:
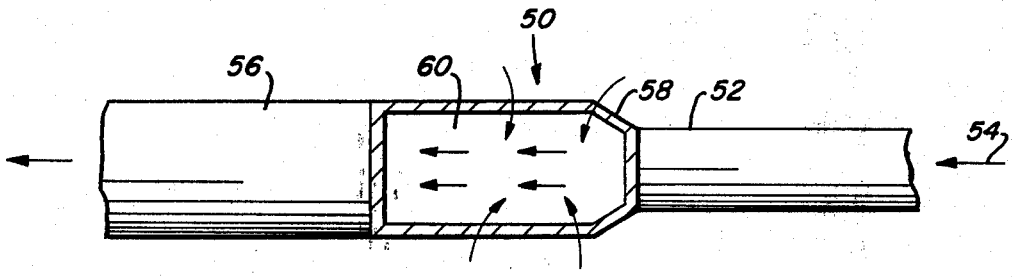
FIG. 2 is a fragmentary view, in section, of apparatus that may be employed to provide a negative pressure on the underside of the web.

In FIG. 2, suitable negative pressure apparatus is illustrated to provide such a negative pressure on the underside of web 18. The negative pressure apparatus designated by the numeral 50 includes a small diameter pipe or conduit 52 connected to a fan (not shown) so that air at a relatively high velocity flows through conduit 52 in the direction of arrow 54. The conduit 52 is connected to a large diameter conduit 56 by the conical section 58. The conduit 56 has a generally rectangular opening 60 therein adjacent the end of conduit 52 and this opening is positioned adjacent the underside of web 18. The increase in diameter from conduit 52 to conduit 56 creates a venturi effect and a negative pressure at opening 60. The negative pressure pulls the severed panels through opening 60 into conduit 56 where the airflow conveys the panels through conduit 56 to a suitable receiver. The opening 60 in the conduit 56 may, for convenience, be referred to as a chip or panel receiving means. It is preferred that the conduits extend across the apparatus in general alignment with the axis of the panel cutter shaft 10. Where desired, the conduits 52 and 56 may be spaced a substantial distance from the underside of web 18 and a hood similar to hood 24 connected to opening 60 in conduit 56. With this arrangement, the panels are conveyed through conduit 56 to a storage receiver without passing through a suction fan.

With the above arrangement, it is now possible to positively remove the panel or chip from a web by means of the negative pressure while the web is traveling at a relatively high speed. The auxiliary blade 32 and air blast means 34 do not limit the speed of the web and may be utilized where necessary. The above apparatus, although described in conjunction with an endless web, may also be employed with envelope blanks where suitable conveyor devices, such as endless straps or the like, are provided to convey the envelope blanks from the panel cutter to a location adjacent the hood 24 and around the turnaround rollers 20 and 22.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for removing panels cut from a material conveyed along a path, comprising, a rotatable panel cutter roll having a panel cutter die extending radially therefrom, anvil means positioned adjacent to said panel cutter roll, said anvil means serving as a rigid backing member for said panel cutter die, conveying means to convey said material between said panel cutter roll and said anvil means so that said panel cutter die upon rotation of said panel cutter roll periodically cuts a window and forms a panel having the configuration of said window in said material, panel receiving means positioned adjacent to and downstream of said panel cutter, and a source of negative pressure connected to said panel receiving means and arranged to provide a negative pressure on a surface of said material adjacent to said panel receiving means at a location downstream of said panel cutter, said negative pressure arranged to remove said panel from said windows and convey said panel through said panel receiving means.

2. Apparatus for removing panels cut from a material conveyed along a path as set forth in claim 1 in which, said conveying means conveys said material around turnaround means to change the direction of said material and remove partially severed panels from said material.

3. Apparatus for removing panels cut from a web being conveyed along a path comprising, a rotatable panel cutter roll rotatably mounted in a frame, a panel cutter die secured to and extending radially from said panel cutter roll, anvil means positioned adjacent to said panel cutter roll, said anvil means serving as a rigid backing member for said panel cutter die, conveying means to convey a web between said panel cutter roll and said anvil means so that said panel cutter die upon rotation of said panel cutter roll periodically cuts a window and forms a panel having the configuration of said window in said web, a roller positioned downstream of said panel cutter roll and in spaced relation thereto, said web with windows formed therein supported on said roll while being conveyed by said conveying means, panel receiving means positioned between said panel cutter roll and said roller, said panel receiving means having an open portion adjacent the undersurface of said web;

a souce of negative pressure connected to said panel receiving means and arranged to provide a negative pressure on the undersurface of said web to remove said panels from said windows formed in said web and convey said panels through said panel receiving means.

4. Apparatus for removing panels cut from a web as set forth in claim 3 in which, said web is reeved around a portion of said roller so that said web changes direction, said roller aranged to remove partially severed panels from said web, said panel receiving means positioned to receive said panels removed by said roller.

5. Apparatus for removing panels cut from a web as set forth in claim 4 which includes, knife means positioned adjacent to said roller, said knife means arranged to engage and remove said partially severed panels as said web is conveyed around said roller.

6. Apparatus for removing panels cut from a web as set forth in claim 3 which includes, air blast means positioned in overlying relation with said web between said panel cutter roll and said roller, said air blast means operable to dislodge panels from said web and propel said clippings into said panel receiving means.

7. Apparatus for removing panels cut from a web being conveyed along a path comprising, a rotatable panel cutter roll having a panel cutter die extending radially therefrom, anvil means positioned adjacent to said panel cutter roll, said anvil means serving as a rigid backing member for said panel cutter die, conveying means to convey a web between said panel cutter roll and said anvil means so that said panel cutter die upon rotation of said panel cutter roll periodically cuts a window and forms a panel having the configuration of said window in said web, panel receiving means positioned adjacent the undersurface of said web downstream of said panel cutter, and air blast means positioned in overlying relation with said web and said panel receiving means, said air blast means arranged to provide a positive pressure on the upper surface of said web to dislodge panels from said web and deposit said panels in said panel receiving means.

8. Apparatus for removing panels cut from a web as set forth in claim 3 in which, said panel receiving means includes a conduit having a first portion with a preselected diameter and a second portion having a diameter larger than said first portion, said conduit second portion having an opening therein positioned adjacent to the underside of said web between said panel cutter roll and said roller, said conduit arranged to convey a stream of air therethrough and form an area of negative pressure at said opening adjacent the underside of said web.

* * * * *